US010132316B2

(12) United States Patent
Nagano et al.

(10) Patent No.: US 10,132,316 B2
(45) Date of Patent: Nov. 20, 2018

(54) SCROLL COMPRESSOR

(71) Applicant: KABUSHIKI KAISHA TOYOTA JIDOSHOKKI, Kariya-shi, Aichi-ken (JP)

(72) Inventors: Hiroki Nagano, Aichi-ken (JP); Tatsushi Mori, Aichi-ken (JP); Ken Suitou, Aichi-ken (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 207 days.

(21) Appl. No.: 14/136,142

(22) Filed: Dec. 20, 2013

(65) Prior Publication Data

US 2014/0178232 A1 Jun. 26, 2014

(30) Foreign Application Priority Data

Dec. 26, 2012 (JP) ..... 2012-283036

(51) Int. Cl.
*F04C 29/02* (2006.01)
*F04C 18/02* (2006.01)
(Continued)

(52) U.S. Cl.
CPC ..... *F04C 29/026* (2013.01); *F04C 18/0215* (2013.01); *F04C 18/0261* (2013.01);
(Continued)

(58) Field of Classification Search
CPC ..... F04C 18/0215; F04C 18/0261; F04C 29/026; F04C 29/028; F04C 27/005
(Continued)

(56) References Cited

U.S. PATENT DOCUMENTS 3,091,213 A * 5/1963 Maskell ..... A62B 9/006 116/34 R
3,998,244 A * 12/1976 Bentley ..... F16K 47/06 138/43
(Continued)

FOREIGN PATENT DOCUMENTS

CN 1333171 C 8/2007
DE 10333536 A1 2/2004
(Continued)

OTHER PUBLICATIONS

English translation JP 1-163484 to Isobe et al by Japan Platform for Patent Information (2015).*
(Continued)

*Primary Examiner* — Mary A Davis
*Assistant Examiner* — Deming Wan
(74) *Attorney, Agent, or Firm* — Sughrue Mion, PLLC

(57) ABSTRACT

A scroll compressor includes a housing having therein a discharge pressure region, a compression pressure region and a suction pressure region; a fixed scroll to form a discharge chamber as the discharge pressure region; and a movable scroll cooperating with the fixed scroll to form a compression chamber as the compression pressure region. The discharge pressure region includes an oil separation chamber connected to at least one of the compression pressure region and the suction pressure region through an oil supply passage having a flow restrictor. The flow restrictor is provided by a gap between an oil supply hole formed in the fixed scroll and an insertion member inserted in the oil supply hole. The gap is in the form of a spiral groove provided in at least one of an inner peripheral surface of the oil supply hole and an outer peripheral surface of the insertion member.

17 Claims, 9 Drawing Sheets

(51) Int. Cl.

| | |
|---|---|
| ***F04C 23/00*** | (2006.01) |
| ***F04C 29/00*** | (2006.01) |
| ***F16L 55/027*** | (2006.01) |
| *F04C 27/00* | (2006.01) |

(52) U.S. Cl.
CPC ..... *F04C 29/028* (2013.01); *F04C 23/008* (2013.01); *F04C 27/005* (2013.01)

(58) Field of Classification Search
USPC ..... 418/55.1–55.6, 270, DIG. 1; 138/40, 43, 138/46
See application file for complete search history.

(56) References Cited

U.S. PATENT DOCUMENTS

| | | | | |
|---|---|---|---|---|
| 4,506,423 | A * | 3/1985 | Nakamura | B21D 26/14 138/149 |
| 4,634,434 | A * | 1/1987 | Marino, Jr. | A61M 5/16881 138/46 |
| 7,264,453 | B2 | 9/2007 | Gennami et al. | |
| 7,318,711 | B2 | 1/2008 | Shin et al. | |
| 2004/0191082 | A1 | 9/2004 | Gennami et al. | |
| 2005/0220652 | A1 | 10/2005 | Yamaji et al. | |
| 2007/0102053 | A1* | 5/2007 | Le | F15D 1/02 138/43 |
| 2009/0304539 | A1* | 12/2009 | Kii | F04C 18/0215 418/55.6 |
| 2011/0243777 | A1 | 10/2011 | Ito et al. | |

FOREIGN PATENT DOCUMENTS

| | | | | |
|---|---|---|---|---|
| JP | 1-163484 | * | 6/1989 | F04C 18/02 |
| JP | 1-163484 | A | 6/1989 | |
| JP | H02-283890 | A | 11/1990 | |
| JP | H10-141256 | A | 5/1998 | |
| JP | H10-297159 | A | 11/1998 | |
| JP | 2002-39067 | A | 2/2002 | |
| JP | 2002-168183 | A | 6/2002 | |
| JP | 2004211550 | A | 7/2004 | |
| JP | 2004-301091 | A | 10/2004 | |
| JP | 2005-127250 | A | 5/2005 | |
| JP | 2005-240646 | A | 9/2005 | |
| JP | 2006-283749 | A | 10/2006 | |
| JP | 2006-348760 | A | 12/2006 | |
| JP | 2009-41429 | A | 2/2009 | |
| JP | 2010-190078 | A | 9/2010 | |
| JP | 2010-285930 | A | 12/2010 | |
| JP | 2012-207547 | A | 10/2012 | |

OTHER PUBLICATIONS

English translation JP 2004-211550 to Sato et al by Japan Platfrom for Patene Information (2015).*
Communication dated Aug. 31, 2015, issued by the State Intellectual Property Office of the People's Republic of China in corresponding Chinese Application No. 20130727235.6.
Communication dated Jul. 5, 2016, issued by the State Intellectual Property Office of the P.R.C. in corresponding Chinese Application No. 201310727235.6.
Communication dated Sep. 13, 2016 issued by the Japan Patent Office in counterpart application No. 2012-283036.
Communication dated Feb. 2, 2016 issued by the Japan Patent Office in counterpart application No. 2012-283036.

* cited by examiner

SCROLL COMPRESSOR

BACKGROUND OF THE INVENTION

The present invention relates to a scroll compressor.

Japanese Unexamined Patent Application Publication No. 2004-301091 discloses a conventional scroll compressor including a housing, a fixed scroll and a movable scroll. The housing has therein a discharge pressure region, a compression pressure region and a suction pressure region. The fixed scroll is fixed in the housing to form a discharge chamber which functions as the discharge pressure region. The movable scroll cooperates with the fixed scroll to form therebetween a compression chamber which functions as the compression pressure region. An oil separator is fixed in the discharge pressure region to form an oil separation chamber. The discharge pressure region is formed by the discharge chamber and the oil separation chamber. The oil separation chamber serves to separate lubricating oil from refrigerant gas discharged from the compression chamber and to store the separated lubricating oil.

The scroll compressor further includes a fixed block and an elastic plate. The fixed block is fixed in the housing to form a suction chamber which functions as the suction pressure region. The fixed block cooperates with the movable scroll to form therebetween a backpressure chamber which functions as the compression pressure region. The elastic plate is flat, annular and held between the peripheral wall of the fixed scroll and the fixed block. The elastic plate is in sliding contact with the movable scroll.

The backpressure chamber and the oil separation chamber are connected by an oil supply passage. The oil supply passage has a flow restrictor that is in the form of a slit formed through the elastic plate, extending in an arcuate shape between the peripheral wall of the fixed scroll and the fixed block. The flow restrictor is made to have a small cross-sectional area.

With an orbital motion of the movable scroll, the compression chamber is moved radially inward while reducing its volume. Refrigerant gas in the suction chamber is introduced into the compression chamber for compression and then discharged into the discharge chamber. Lubricating oil contained in the refrigerant gas is separated in the oil separation chamber and stored therein. The separated lubricating oil is moved through the oil supply passage to the backpressure chamber and serves to increase the pressure of the backpressure chamber. As a result, the movable scroll is urged toward the fixed scroll by elasticity of the elastic plate and the pressure of the backpressure chamber so that the compression chamber is appropriately sealed.

The lubricating oil having been moved through the oil supply passage to the backpressure chamber is returned to the suction chamber and used for lubrication of components such as an electric motor provided in the suction chamber. In this case, the flow restrictor formed in the elastic plate is filled with lubricating oil, which serves to prevent the flow of refrigerant gas through the oil supply passage, resulting in reduced power loss of the scroll compressor caused by the flow of refrigerant gas between the backpressure chamber and the oil separation chamber of discharge pressure through the oil supply passage.

In the above-described scroll compressor in which the flow restrictor is provided in the elastic plate, the cross-sectional area of the flow restrictor is not necessarily small enough to reduce the power loss of the compressor. However, forming the flow restrictor of a smaller cross-sectional area in the elastic plate by press requires higher accuracy, which reduces productivity of the scroll compressor and makes it difficult to reduce its manufacturing cost.

The present invention is directed to providing a scroll compressor that allows reduced manufacturing cost and reduced power loss.

SUMMARY OF THE INVENTION

In accordance with an aspect of the present invention, a scroll compressor includes a housing having therein a discharge pressure region, a compression pressure region and a suction pressure region; a fixed scroll fixed in the housing to form a discharge chamber serving as the discharge pressure region; and a movable scroll cooperating with the fixed scroll to form therebetween a compression chamber serving as the compression pressure region. The discharge pressure region includes an oil separation chamber for separating lubricating oil from refrigerant gas discharged from the compression chamber. The oil separation chamber is connected to at least one of the compression pressure region and the suction pressure region through an oil supply passage having a flow restrictor. The flow restrictor is provided by a gap between an oil supply hole formed in the fixed scroll and an insertion member inserted in the oil supply hole. The gap is in the form of a spiral groove provided in at least one of an inner peripheral surface of the oil supply hole and an outer peripheral surface of the insertion member.

Other aspects and advantages of the invention will become apparent from the following description, taken in conjunction with the accompanying drawings, illustrating by way of example the principles of the invention.

DETAILED DESCRIPTION OF EMBODIMENTS

The following will describe the embodiments of the electric scroll compressor according to the present invention with reference to the accompanying drawings.

Figure 1:
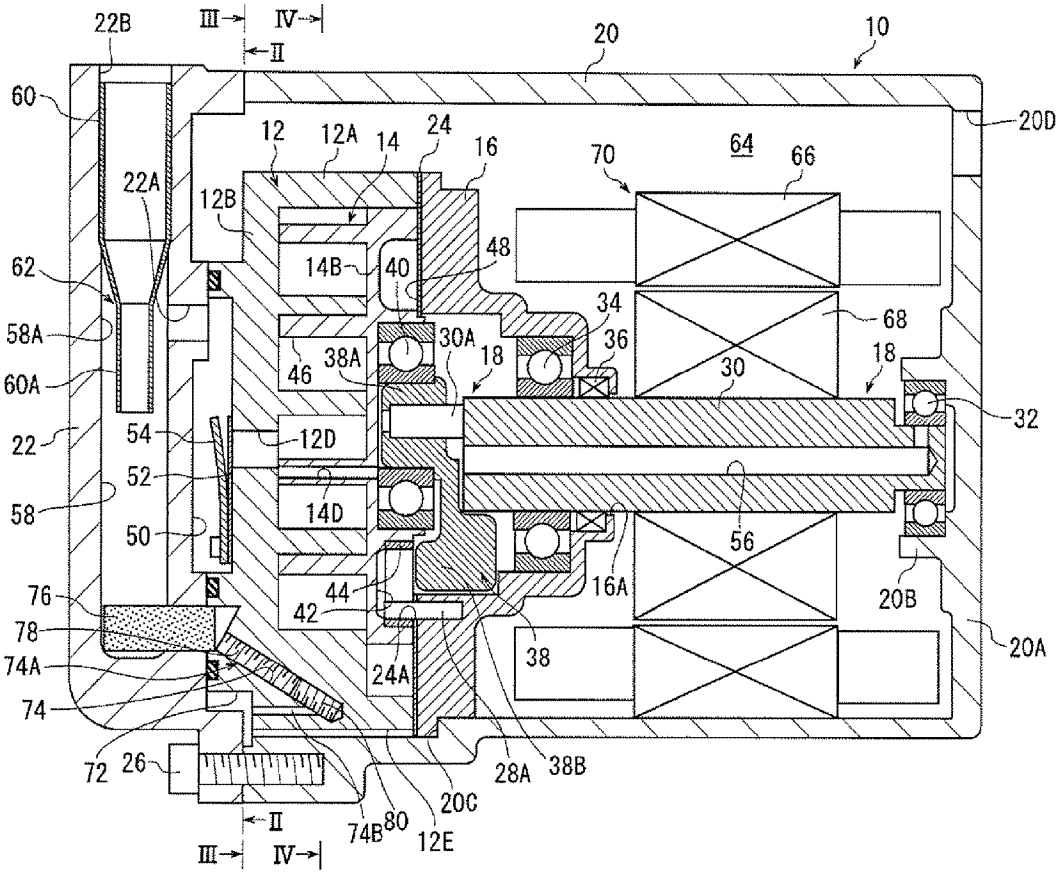
FIG. 1 is a longitudinal sectional view of an electric scroll compressor according to a first embodiment of the present invention.

Referring to FIG. 1, the electric scroll compressor of the first embodiment includes a housing 10, a fixed scroll 12, a movable scroll 14, a fixed block 16, and an orbiting mechanism 18. It is noted that the right-hand side and the left-hand side of the compressor as viewed in FIG. 1 correspond to its front side and rear side, respectively, and that the upper and lower sides of the compressor as viewed in FIG. 1 correspond to its upper and lower sides, respectively.

The housing 10 is formed of a cylindrical front housing 20 having an opening at its rear end and a rear housing 22 closing the opening of the front housing 20. In the front housing 20, the fixed scroll 12 is provided rearward of the fixed block 16. A flat and annular elastic plate 24 is interposed between the fixed scroll 12 and the fixed block 16.

The front housing 20 and the rear housing 22 are in contact with each other at their ends and fixed together by a plurality of bolts 26 while keeping the elastic plate 24 in contact with the fixed block 16 and the fixed scroll 12. The elastic plate 24 is fixed in the front housing 20 with its outer periphery held between the front end of a peripheral wall 12A of the fixed scroll 12 and the rear end of an outer periphery of the fixed block 16.

The front housing 20 has an end wall 20A having at the center thereof a cylindrical shaft support portion 20B projecting inward of the front housing 20. The fixed block 16 has a central hole 16A formed therethrough and coaxial with the shaft support portion 20B. The outer periphery of the fixed block 16 except its upper part is set in contact with a step 20C formed on the inner peripheral surface of the front housing 20, so that the position of the fixed block 16 is fixed. The fixed block 16 has a plurality of pins 28A (only one being shown) fixed thereto. Each pin 28A projects rearward from the fixed block 16 and is inserted through a hole 24A formed through the elastic plate 24.

There is provided in the front housing 20 a rotary shaft 30 extending longitudinally of the compressor and rotatably supported by the fixed block 16 and the shaft support portion 20B of the front housing 20 via radial bearings 32, 34. The fixed block 16 is equipped with a seal 36 for sealing between the fixed block 16 and the rotary shaft 30.

The rotary shaft 30 has at its rear end a cylindrical eccentric pin 30A that is eccentric to the central axis of the rotary shaft 30. The eccentric pin 30A is fitted in a drive bushing 38. The drive bushing 38 includes a cylindrical bushing 38A and a balance weight 38B in the form of a sector extending radially outward from the periphery of the bushing 38A. The drive bushing 38 serves to offset the centrifugal force caused by orbital motion of the movable scroll 14.

Figure 3:
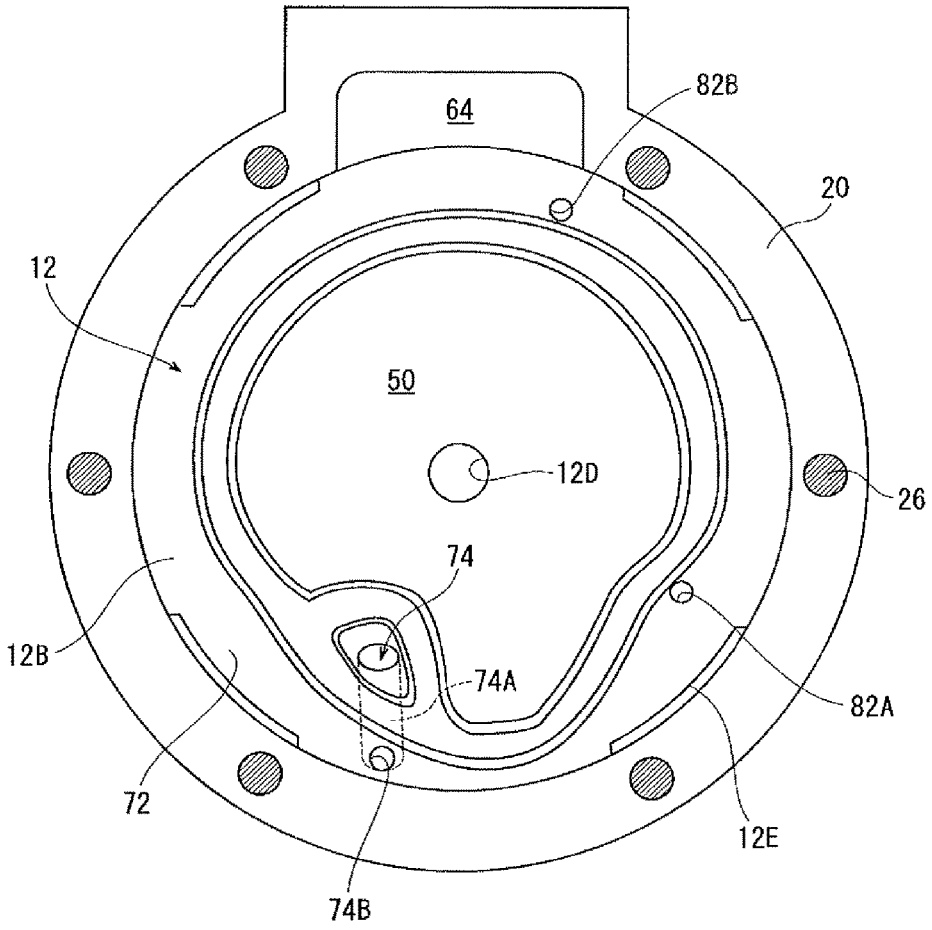
FIG. 3 is a rear view of a fixed scroll of the scroll compressor taken along the line III-III of FIG. 1.
Figure 4:
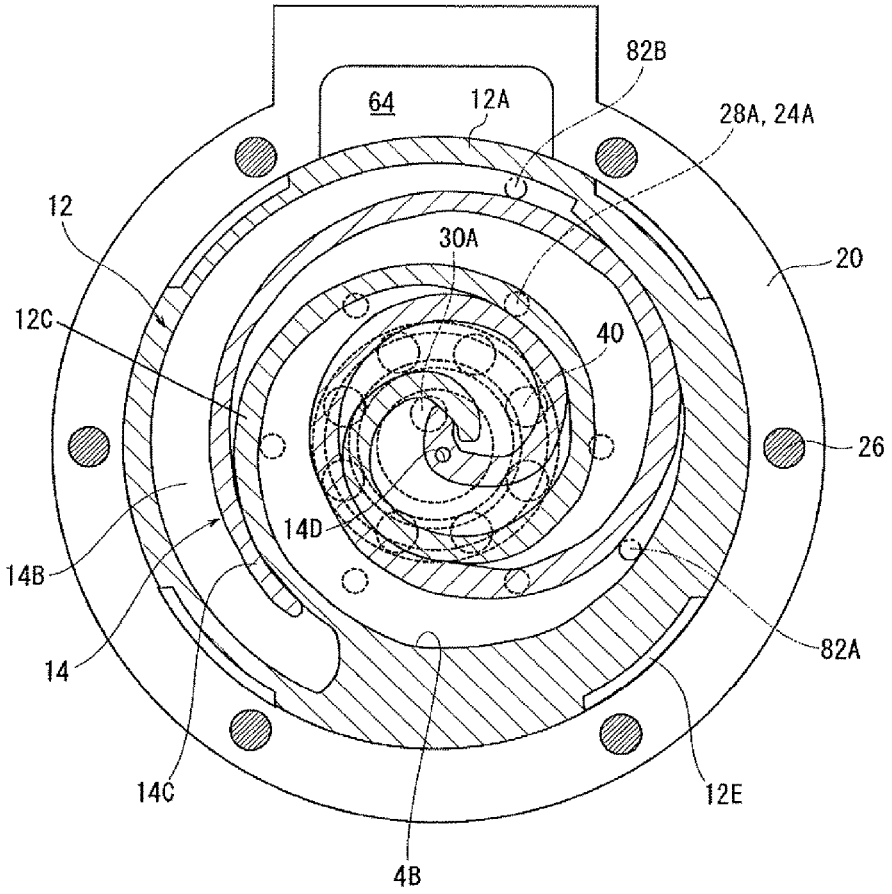
FIG. 4 is a partially cross-sectional view of the scroll compressor taken along the line IV-IV of FIG. 1.

Referring also to FIGS. 3 and 4, the fixed scroll 12 includes a circular base plate 12B, a cylindrical peripheral wall 12A extending forward from the outer periphery of the base plate 12B, and a spiral wall 12C projecting forward from the base plate 12B at a position radially inward of the peripheral wall 12A.

As shown in FIG. 1, the movable scroll 14 is provided between the bushing 38A and the fixed scroll 12 via a radial bearing 40. The movable scroll 14 includes a circular base plate 14B and a spiral wall 14C projecting rearward from the base plate 14B.

The fixed scroll 12 and the movable scroll 14 are disposed In engagement with each other. The distal end of the spiral wall 12C of the fixed scroll 12 slides on the base plate 14B of the movable scroll 14, while the distal end of the spiral wall 14C of the movable scroll 14 slides on the base plate 12B of the fixed scroll 12. The spiral wall 12C and the spiral wall 14C are slidable with each other.

The base plate 14B of the movable scroll 14 has its front end surface plural recesses 42 (only one being shown) that receives the pins 28A of the fixed block 16 in loose fit relation. Cylindrical rings 44 (only one being shown) are loosely fit in the respective recesses 42. The pin 28A slides and rolls on the inner surface of the ring 44, so that the movable scroll 14 is prevented from rotating on its own axis and allowed to orbit. The pins 28A, the recesses 42 and the rings 44 cooperate with each other to serve to prevent rotation of the movable scroll 14 on its own axis. The rotary shaft 30, the eccentric pin 30A, the drive bushing 38 and such rotation preventing mechanism cooperate with each other to serve as the orbiting mechanism 18.

The front surface of the base plate 14B of the movable scroll 14 is set in contact with the rear surface of the elastic plate 24. The movable scroll 14 orbits in sliding contact with the elastic plate 24. The elastic plate 24 is made by applying nitriding treatment for improving slidability of the movable scroll 14 to both surfaces of a thin metal plate having a thickness of about 0.2 mm to 0.3 mm. The movable scroll 14 is urged toward the fixed scroll 12 by elasticity of the elastic plate 24.

A compression chamber 46 is formed by the base plate 12B and the spiral wall 12C of the fixed scroll 12 and the base plate 14B and the spiral wall 14C of the movable scroll 14. A backpressure chamber 48 where the rear end of the rotary shaft 30 is exposed is formed between the base plate 14B and the fixed block 16.

Figure 2:
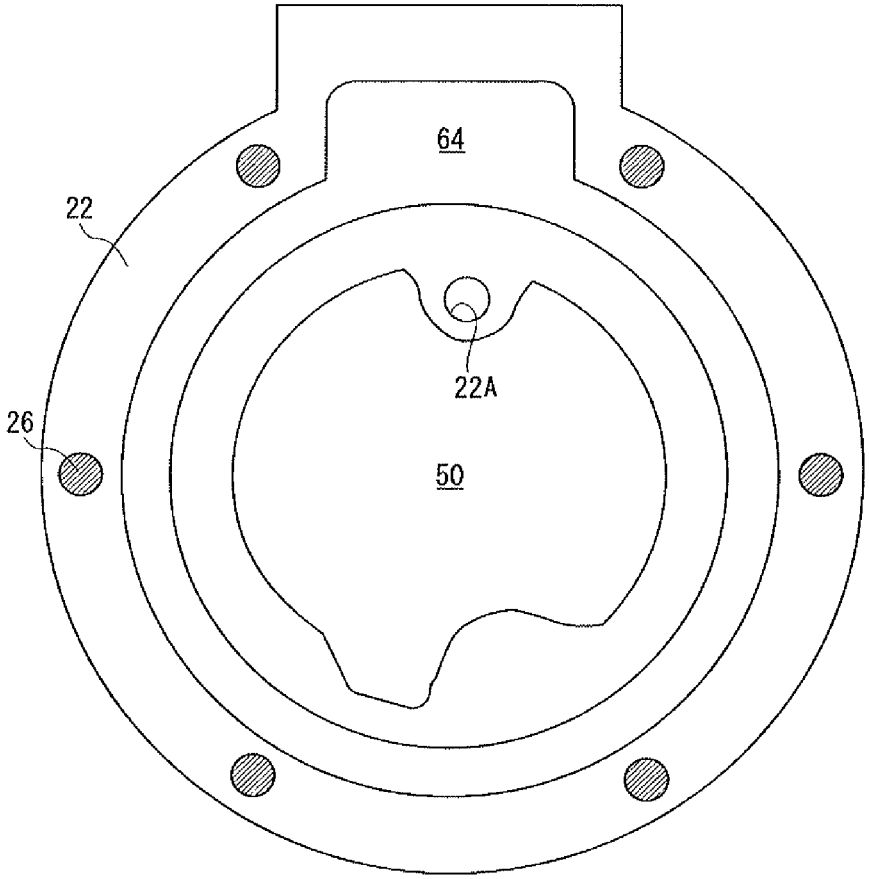
FIG. 2 is a front view of a rear housing of the scroll compressor taken along the line II-II of FIG. 1.

A discharge chamber 50 is formed between the fixed scroll 12 and the rear housing 22 (see FIG. 2). The discharge chamber 50 and the compression chamber 46 are connected by a discharge port 12D formed through the base plate 12B of the fixed scroll 12. There is also provided in the discharge chamber 50 a reed valve 52 operable to open and close the discharge port 12D and a retainer 54 regulating the opening the reed valve 52.

The movable scroll 14 has a gas supply hole 14D extending in parallel to the central axis of the movable scroll 14 through a radially central part of the spiral wall 14C and the base plate 14B. The gas supply hole 14D slightly opens to the compression chamber 46 and communicates with the inside of the fixed block 16 via the radial bearing 40 and the drive bushing 38. The pressure in the backpressure chamber 48 is increased by high-pressure refrigerant gas supplied from the compression chamber 46 through the gas supply hole 14D.

The rotary shaft 30 has an oil supply hole 56 formed therethrough. The oil supply hole 56 extends between the rear end of the rotary shaft 30 and an inner race of the radial bearing 32 so that high-pressure lubricating oil present in the compression chamber 46 is supplied to the radial bearing 32.

The rear housing 22 forms therein a vertically extending oil separation chamber 58. A tubular member 60 having a cylindrical outer peripheral surface 60A is fixed in the upper part of the oil separation chamber 58. An inner peripheral surface 58A of the oil separation chamber 58 and the outer peripheral surface 60A of the tubular member 60 are in facing relation and coaxial with each other. The oil separation chamber 58 and the tubular member 60 cooperate to serve as a centrifugal oil separator 62. The discharge chamber 50 is connected through a discharge passage 22A (see FIG. 2) to the oil separation chamber 58 at a position facing the outer peripheral surface 60A of the tubular member 60. The rear housing 22 has at its upper end an outlet port 22B that connects the inside of the tubular member 60 and an external refrigerant circuit (not shown).

The inside of the front housing 20 serves as a motor chamber 64 which receives an electric motor 70 and functions as suction chamber. In the motor chamber 64, a rotor 68 is fixed to the rotary shaft 30, and a stator 66 is fixed to the inner peripheral surface of the front housing 20 around the rotor 68. The rotor 68, the stator 66 and the rotary shaft 30 cooperate to serve as the electric motor 70. The front housing 20 has at its upper part an inlet port 20D that connects the motor chamber 64 and the external refrigerant circuit. Although not shown in the drawing, a suction passage for connecting the motor chamber 64 and the compression chamber 46 is formed by the fixed block 16, the peripheral wall 12A of the fixed scroll 12 and the radially outermost part of the spiral wall 14C of the movable scroll 14.

The discharge chamber 50 and the oil separation chamber 58 correspond to the discharge pressure region of the present invention. The motor chamber 64A also serving as the suction chamber corresponds to the suction pressure region of the present invention. The compression chamber 46 and the backpressure chamber 48 correspond to the compression pressure region of the present invention.

As shown in FIGS. 1 and 3, the fixed scroll 12 is formed with an oil supply passage 74. The oil supply passage 74 includes an oil storage space 72, a plurality of recesses 12E, a flow restrictor 74A, a connecting passage 74B, a first oil return hole 82A, and a second oil return hole 82B.

The oil storage space 72 is in the form of an annular ring and formed by the front housing 20, the rear housing 22 and the fixed scroll 12. As shown in FIGS. 3 and 4, the recesses 12E are formed in the outer peripheral surface of the peripheral wall 12A of the fixed scroll 12. The oil storage space 72 communicates with the motor chamber 64 through the recesses 12E.

Figure 5:
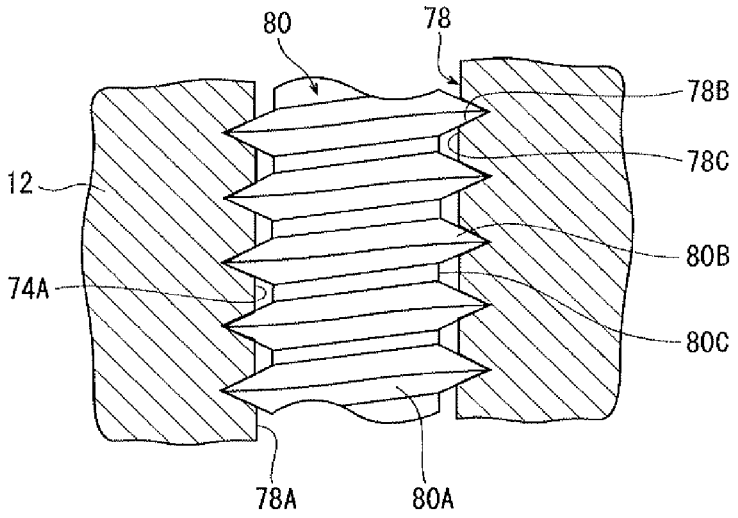
FIG. 5 is an enlarged fragmentary sectional view of a flow restrictor of the scroll compressor of FIG. 1.
Figure 6:
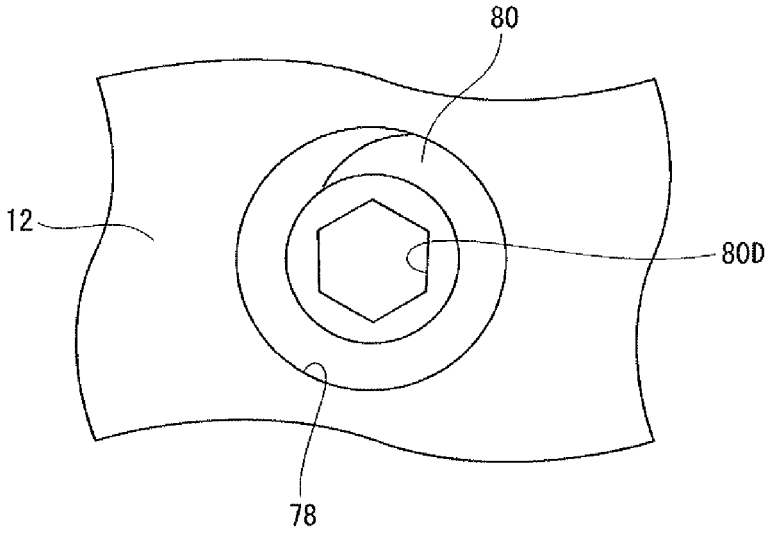
FIG. 6 is another enlarged fragmentary view of the flow restrictor.

Referring to FIGS. 5 and 6, the flow restrictor 74A is provided by a gap between a threaded hole 78 formed in the fixed scroll 12 through the base plate 12B and the peripheral wall 12A (see FIG. 1) and an externally threaded member 80 engaged with the threaded hole 78. The flow restrictor 74A is formed by an inner peripheral surface 78A of the threaded hole 78 and an outer peripheral surface 80A of the externally threaded member 80.

Specifically, the threaded hole 78 (oil supply hole) has a thread groove 78B and a thread ridge 78C. The bottom of the thread groove 78B is sharp, while the top of the thread ridge 78C is in the form of a cylindrical surface. Referring back to FIG. 1, there is provided in the rear housing 22 a filter 76 between the oil separation chamber 58 and the threaded hole 78.

The externally threaded member 80 (insertion member) is a standard metal set screw. As shown in FIG. 6, the externally threaded member 80 has at its end facing the rear housing 22 a hexagonal recess 80D to be turned by a hexagonal wrench. As shown in FIG. 5, the externally threaded member 80 has a thread ridge 80B and a thread groove 80C. The top of the thread ridge 80B is sharp, while the bottom of the thread groove 80C is in the form of a cylindrical surface.

In the scroll compressor of the first embodiment, the depth of the thread groove 80C of the externally threaded member 80 is deeper than the height of the thread ridge 78C of the threaded hole 78. In other words, the height of the thread ridge 78C of the threaded hole 78 is smaller than the depth of the thread groove 80C of the externally threaded member 80. With the thread groove 78B of the threaded hole 78 and the thread ridge 80B of the externally threaded member 80 engaged with each other, the gap between the thread ridge 78C of the threaded hole 78 and the thread groove 80C of the externally threaded member 80 is in the form of a spiral groove and serves as the flow restrictor 74A with small cross-sectional area. The length and the cross-sectional area of the flow restrictor 74A is adjustable depending on the nominal sizes, the pitches, the circumferences and the thread lengths of the threaded hole 78 and the externally threaded member 80.

The passage 74B extends between the oil storage space 72 and the part of the threaded hole 78 where the externally threaded member 80 is engaged. The restrictor 74A and the passage 74B cooperate to connect the oil separation chamber 58 and the oil storage space 72.

As shown in FIGS. 3 and 4, the first oil return hole 82A and the second oil return hole 82B are formed extending through the fixed scroll 12. The first oil return hole 82A connects a lower part of the oil storage space 72 and the compression chamber 46. The second oil return hole 82B connects an upper part of the oil storage space 72 and the compression chamber 46. The inner diameter of the second oil return hole 82B is set slightly larger than the inner diameter of the first oil return hole 82A.

The compression chamber 46 as the compression pressure region communicates with the oil separation chamber 58 through the flow restrictor 74A, the connecting passage 74B, the oil storage space 72, the first oil return hole 82A and the second oil return hole 82B of the oil supply passage 74. The motor chamber 64 as the suction pressure region communicates with the oil separation chamber 58 through the flow restrictor 74A, the connecting passage 74B, the oil storage space 72 and the recesses 12E of the oil supply passage 74.

Although not shown in FIG. 1, the inlet port 20D of the compressor is connected through a pipe to an evaporator that is in turn connected through a pipe to an expansion valve and a condenser. The condenser is connected through a pipe to the outlet port 22B of the compressor. The compressor, the evaporator, the expansion valve and the condenser cooperate to form a refrigeration circuit of a vehicle air conditioner.

In the above-described scroll compressor, while the rotary shaft 30 of the electric motor 70 is being rotated, the compression chamber 46 between the fixed scroll 12 and the movable scroll 14 is moved radially inward while reducing its volume with the orbital motion of the movable scroll 14 caused by the orbiting mechanism 18. Refrigerant gas in the motor chamber 64 is introduced into the compression chamber 46 for compression and then discharged into the discharge chamber 50. The movable scroll 14 is urged toward the fixed scroll 12 by elasticity of the elastic plate 24 and the pressure of the backpressure chamber 48 so that the compression chamber 46 is appropriately sealed.

Lubricating oil contained in the refrigerant gas discharged from the compression chamber 46 into the oil separation chamber 58 is separated by the oil separator 62 and stored in the oil separation chamber 58. The separated lubricating oil is returned through the flow restrictor 74A, the connecting passage 74B, the oil storage space 72 and the recesses 12E of the oil supply passage 74 to the motor chamber 64 also serving as the suction chamber, and used for lubrication of components provided in the motor chamber 64 such as the electric motor 70. In this case, the flow restrictor 74A is filled with lubricating oil, which prevents the flow of refrigerant gas through the oil supply passage 74, thereby resulting in reduced power loss caused by the flow of refrigerant gas between the motor chamber 64 as the suction pressure region and the oil separation chamber 58 through the oil supply passage 74 and preventing communication between the discharge chamber 50 and the motor chamber 64 as the suction chamber.

The lubricating oil separated and stored in the oil separation chamber 58 is also supplied to the compression chamber 46 through the flow restrictor 74A, the connecting passage 74B, the oil storage space 72, the first oil return hole 82A and the second oil return hole 82B of the oil supply passage 74, and used for lubrication of sliding components such as the fixed scroll 12 and the movable scroll 14. Also In this case, the flow restrictor 74A is filled with lubricating oil, which prevents the flow of refrigerant through the oil supply passage 74, thereby resulting in reduced power loss caused by the flow of refrigerant gas between the compression chamber 46 as the compression pressure region and the oil separation chamber 58 through the oil supply passage 74 and preventing communication between the discharge chamber 50 and the compression chamber 46. The filter 76 serves to collect any foreign matter contained in lubricating oil and prevent the flow restrictor 74A from being blocked by foreign matter.

As shown in FIG. 5, the flow restrictor 74A is formed by the threaded hole 78 and the externally threaded member 80 which are provided in the fixed scroll 12. The externally threaded member 80 whose thread groove 80C is deeper than the thread ridge 78C of the threaded hole 78 is used. Appropriately selecting the dimension of the externally threaded member 80, the flow restrictor 74A of a sufficiently small cross-sectional area can be easily provided. Since there is no need to form a conventional flow restrictor such as slit in the elastic plate 24, the elastic plate 24 can be easily manufactured by pressing.

The use of a standard screw as the externally threaded member 80 allows reduced manufacturing cost. Further, the use of a set screw as the externally threaded member 80 allows the externally threaded member 80 to be engaged with the threaded hole 78 over the entire length of the externally threaded member 80, resulting in increased length of the flow restrictor 74A. The provision of the hexagonal recess 80D in the externally threaded member 80 as shown in FIG. 6 makes it easy to engage the externally threaded member 80 with the threaded hole 78.

Thus, the scroll compressor of the first embodiment allows reduced manufacturing cost and reduced power loss.

Figure 7:
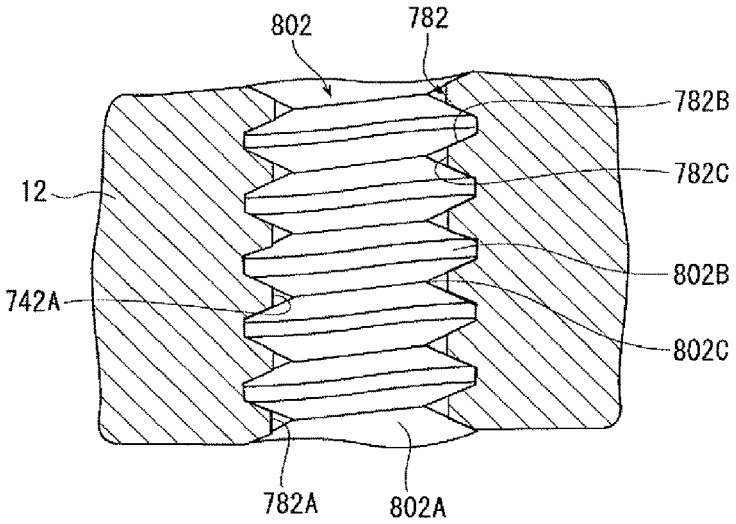
FIG. 7 is an enlarged fragmentary sectional view of a second embodiment of the flow restrictor of the scroll compressor.

FIG. 7 shows the second embodiment of the flow restrictor of the scroll compressor according to the present invention. The flow restrictor designated by 742A is formed by an inner peripheral surface 782A of a threaded hole 782 formed in the fixed scroll 12 and an outer peripheral surface 802A of an externally threaded member 802.

Specifically, the threaded hole 782 has a thread groove 782B and a thread ridge 782C. The bottom of the thread groove 782B is in the form of a cylindrical surface. The top of the thread ridge 782C is in the form of a cylindrical surface.

The externally threaded member 802 has a thread ridge 802B and a thread groove 802C. The top of the thread ridge 802B is in the form of a cylindrical surface. The bottom of the thread groove 802C is sharp.

The depth of the thread groove 802C of the externally threaded member 802 is deeper than the height of the thread ridge 782C of the threaded hole 782. In other words, the height of the thread ridge 782C of the threaded hole 782 is smaller than the depth of the thread groove 802C of the externally threaded member 802. With the thread groove 782B of the threaded hole 782 and the thread ridge 802B of the externally threaded member 802 engaged with each other, the gap between the thread groove 802C of the externally threaded member 802 and the thread ridge 782C of the threaded hole 782 serves as the flow restrictor 742A. Other elements or components are similar to their counterpart elements or components of the first embodiment.

The scroll compressor of the second embodiment also provides the advantages similar to those of the first embodiment.

Figure 8:
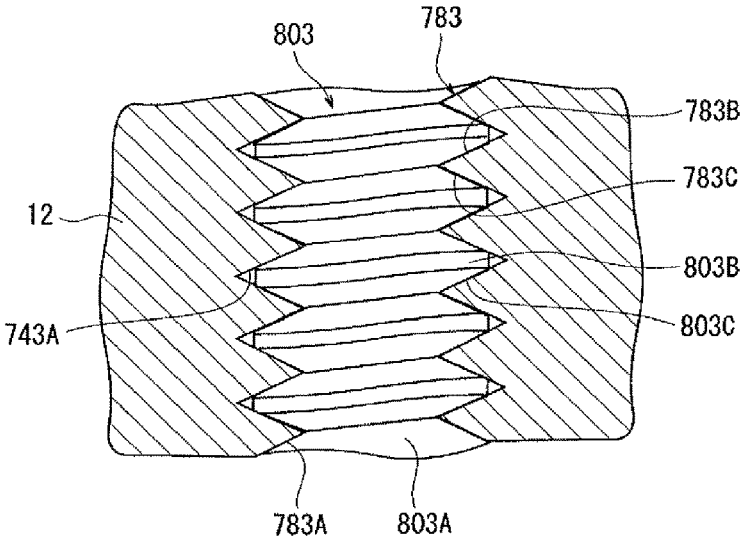
FIG. 8 is an enlarged fragmentary sectional view of a third embodiment of the flow restrictor of the scroll compressor.

FIG. 8 shows the third embodiment of the flow restrictor of the scroll compressor according to the present invention. The flow restrictor designated by 743A is formed by an inner peripheral surface 783A of a threaded hole 783 formed in the fixed scroll 12 and an outer peripheral surface 803A of an externally threaded member 803.

Specifically, the threaded hole 783 has a thread groove 783B and a thread ridge 783C. The bottom of the thread groove 783B is sharp. The top of the thread ridge 783C is also sharp.

The externally threaded member 803 has a thread ridge 803B and a thread groove 803C. The top of the thread ridge 803B is in the form of a cylindrical surface. The bottom of the thread groove 803C is sharp.

The depth of the thread groove 783B of the threaded hole 783 is deeper than the height of the thread ridge 803B of the externally threaded member 803. In other words, the height of the thread ridge 803B of the externally threaded member 803 is smaller than the depth of the thread groove 783B of the threaded hole 783. With the thread ridge 783C of the threaded hole 783 and the thread groove 803C of the externally threaded member 803 engaged with each other, the gap between the thread groove 783B of the threaded hole 783 and the thread ridge 803B of the externally threaded member 803 serves as the flow restrictor 743A. Other elements or components are similar to their counterpart elements or components of the first embodiment.

The scroll compressor of the third embodiment also provides the advantages similar to those of the first embodiment.

Figure 9:
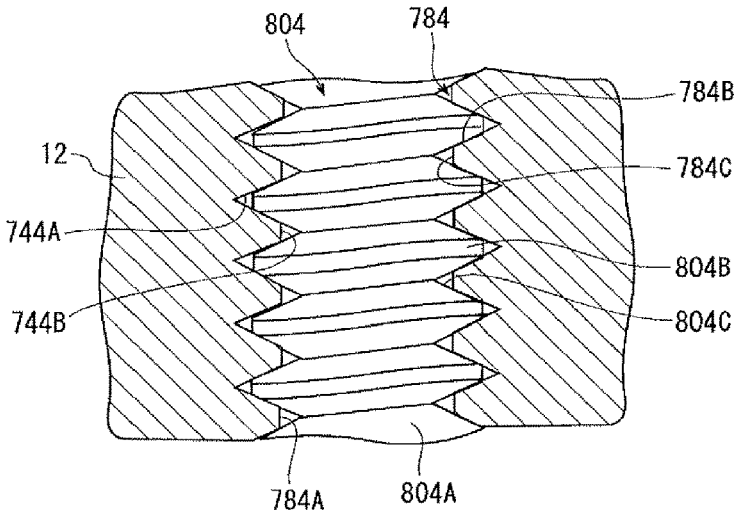
FIG. 9 is an enlarged fragmentary sectional view of a fourth embodiment of the flow restrictor of the scroll compressor.

FIG. 9 shows the fourth embodiment of the flow restrictor of the scroll compressor according to the present invention. The flow restrictors designated by 744A, 744B are formed by an inner peripheral surface 784A of a threaded hole 784 formed in the fixed scroll 12 and an outer peripheral surface 804A of an externally threaded member 804.

Specifically, the threaded hole 784 has a thread groove 784B and a thread ridge 784B. The bottom of the thread groove 784B is sharp. The top of the thread ridge 784C is in the form of a cylindrical surface.

The externally threaded member 804 has a thread ridge 804B and a thread groove 804C. The top of the thread ridge 804B is in the form of a cylindrical surface. The bottom of the thread groove 804C is sharp.

The depth of the thread groove 804C of the externally threaded member 804 is deeper than height of the thread ridge 784C of the threaded hole 784. In other words, the height of the thread ridge 784C of the threaded hole 784 is smaller than the depth of the thread groove 804C of the externally threaded member 804. Also, the depth of the thread groove 784B of the threaded hole 784 is deeper than height of the thread ridge 804B of the externally threaded member 804. In other words, the height of the thread ridge 804B of the externally threaded member 804 is smaller than the depth of the thread groove 784B of the threaded hole 784. With the thread ridge 784C of the threaded hole 784 and the thread ridge 804B of the externally threaded member

804 engaged with each other, the gap between the thread ridge 784C of the threaded hole 784 and the thread groove 804C of the externally threaded member 804 serves as the flow restrictor 744B, while the gap between the thread groove 784B of the threaded hole 784 and the thread ridge 804B of the externally threaded member 804 serves as the flow restrictor 744A. Other elements or components are similar to their counterpart elements or components of the first embodiment.

The scroll compressor of the fourth embodiment also provides the advantages similar to those of the first embodiment.

Figure 10:
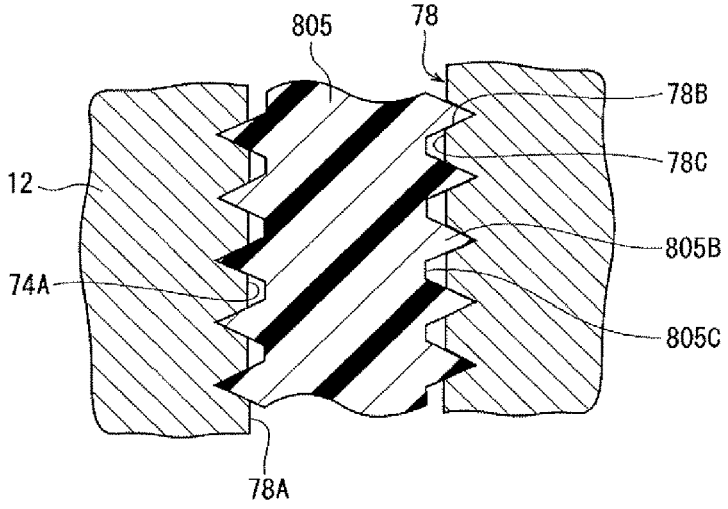
FIG. 10 is an enlarged fragmentary sectional view of a fifth embodiment of the flow restrictor of the scroll compressor.

FIG. 10 shows the fifth embodiment of the flow restrictor of the scroll compressor according to the present invention. The externally threaded member designated by 805 is made of resin. Other elements or components are similar to their counterpart elements or components of the first embodiment.

The scroll compressor of the fifth embodiment also provides the advantages similar to those of the first embodiment. Boring the thread groove 805C and shaving the thread ridge 805B, the flow restrictor 74A of a desired cross-sectional area can be easily provided.

Figure 11:
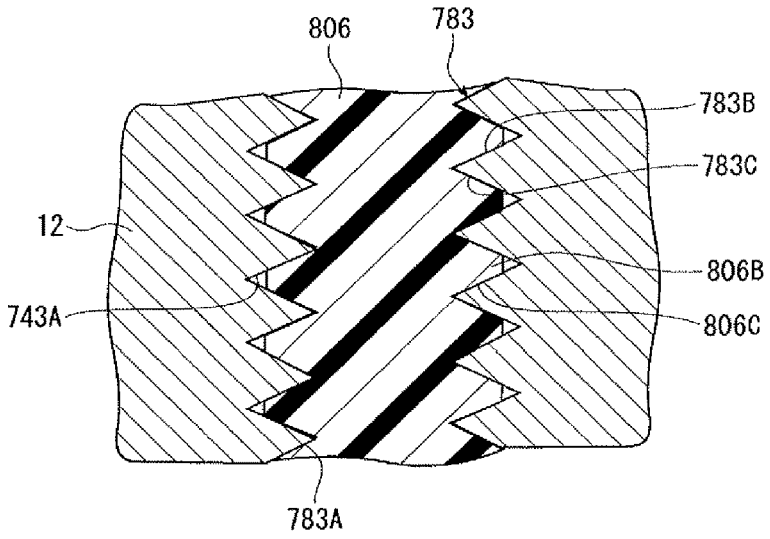
FIG. 11 is an enlarged fragmentary sectional view of a sixth embodiment of the flow restrictor of the scroll compressor.

FIG. 11 shows the sixth embodiment of the flow restrictor of the scroll compressor according to the present invention. The externally threaded member designated by 806 is made of resin and in the form of a cylindrical bar before engagement with the threaded hole 783. Other elements or components are similar to their counterpart elements or components of the third embodiment.

The scroll compressor of the sixth embodiment also provides the advantages similar to those of the third embodiment. Engaging the cylindrical resin bar with the threaded hole 783 so that the thread ridge 806B is formed, the flow restrictor 743A of a desired cross-sectional area can be easily provided, resulting in reduced cost of the externally threaded member 806 before engagement with the threaded hole 783.

Figure 12:
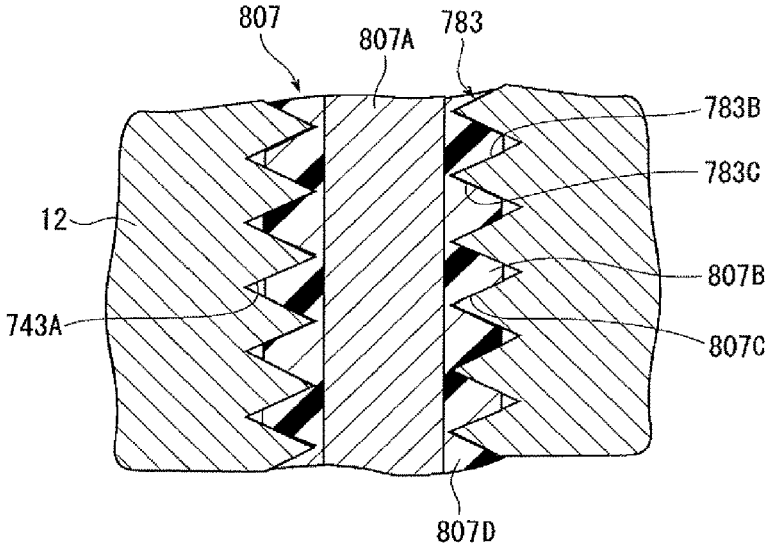
FIG. 12 is an enlarged fragmentary sectional view of the flow restrictor of a seventh embodiment of the scroll compressor.

FIG. 12 shows the seventh embodiment of the flow restrictor of the scroll compressor according to the present invention. The externally threaded member designated by 807 includes a base 807A made of metal and a threaded portion 807D made of resin and provided on the base 807A. The threaded portion 807D has a thread ridge 807B and a thread groove 807C. Other elements or components are similar to their counterpart elements or components of the third embodiment.

The scroll compressor of the seventh embodiment also provides the advantages similar to those of the third embodiment. Engaging the externally threaded member 807 with the threaded hole 783 so that the thread ridge 807B and the thread groove 807C are formed, the flow restrictor 743A of a desired cross-sectional area and of an increased durability can be easily provided.

Figure 13:
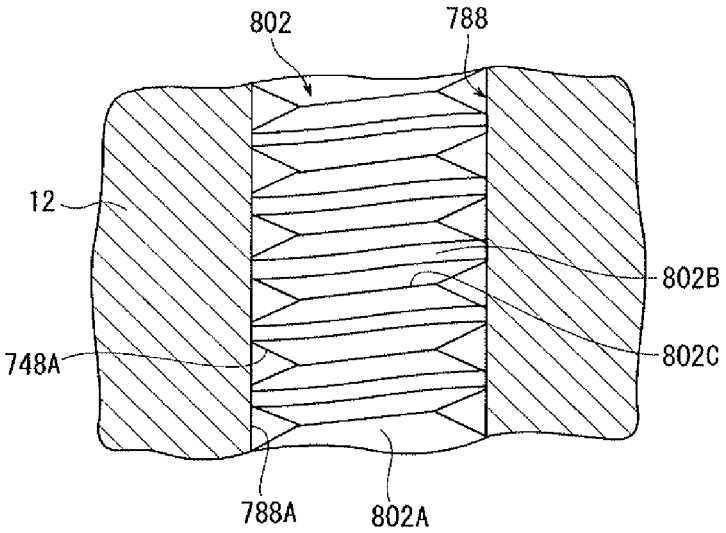
FIG. 13 is an enlarged fragmentary sectional view of the flow restrictor of an eighth embodiment of the scroll compressor.

FIG. 13 shows the eighth embodiment of the flow restrictor of the scroll compressor according to the present invention. The flow restrictor designated by 748A is formed by an inner peripheral surface 788A of an oil supply hole 788 formed in the fixed scroll 12 and the outer peripheral surface 802A of the externally threaded member 802.

Specifically, the oil supply hole 788 has a circular cross section and extends straight so that the inner peripheral surface 788A is in the form of a cylindrical surface. The externally threaded member 802 is as explained in the second embodiment.

Inserting the externally threaded member 802 into the oil supply hole 788, the top of the thread ridge 802B of the externally threaded member 802 comes into contact with the inner peripheral surface 788A of the oil supply hole 788, so that the gap between the thread groove 802C of the externally threaded member 802 and the inner peripheral surface 788A of the oil supply hole 788 serves as the flow restrictor 748A. Other elements or components are similar to their counterpart elements or components of the first embodiment.

The scroll compressor of the eighth embodiment also provides the advantages similar to those of the first embodiment.

It is to be understood that the present invention is not limited to the above-described embodiments, but it may be modified in various ways without departing from the scope of the invention.

For example, it may be so modified that an oil supply passage connected to the suction pressure region is provided separately from an oil supply passage connected to the compression pressure region and each of such passages has a flow restrictor.

The externally threaded member may be made of various materials such as metal, ceramic and resin. In the externally threaded member, the thread groove and the thread ridge may be previously formed before the externally threaded member is engaged with the threaded hole, or the thread groove and the thread ridge may be formed by the threaded hole when the externally threaded member is engaged with the threaded hole.

What is claimed is:

1. A scroll compressor, comprising:

a housing having therein a discharge pressure region, a compression pressure region and a suction pressure region;

a fixed scroll fixed in the housing to form a discharge chamber serving as the discharge pressure region;

a movable scroll cooperating with the fixed scroll to form therebetween a compression chamber serving as the compression pressure region, wherein the discharge pressure region includes an oil separation chamber for separating lubricating oil from refrigerant gas discharged from the compression chamber;

an oil supply passage having a flow restrictor, wherein the oil separation chamber communicates with the compression pressure region or the suction pressure region or the compression pressure region and the suction pressure region through the oil supply passage;

the lubricating oil flowing through the flow restrictor, thereby preventing the flow of refrigerant gas through the oil supply passage; and an insertion member made of resin, wherein the flow restrictor is provided by a gap between an oil supply hole in the oil supply passage and the insertion member that is fixedly inserted in the oil supply hole, the gap is in the form of a spiral groove provided in an inner peripheral surface of the oil supply hole or an outer peripheral surface of the insertion member or the inner peripheral surface of the oil supply hole and the outer peripheral surface of the insertion member, wherein an entire length of the spiral groove is disposed inside the oil supply hole of the oil supply passage.

2. The scroll compressor of claim 1, wherein the oil supply hole is a threaded hole having a thread ridge and a thread groove, the insertion member is an externally threaded member having a thread ridge and a thread groove and engaged with the threaded hole, the spiral groove is at least one of the thread groove of the threaded hole and the thread groove of the externally threaded member, and the flow restrictor is provided by the gap between the threaded hole and the externally threaded member.

3. The scroll compressor of claim 2, wherein the flow restrictor is provided by the gap between the thread ridge of the threaded hole and the thread groove of the externally threaded member.

4. The scroll compressor of claim 2, wherein the flow restrictor is provided by the gap between the thread groove of the threaded hole and the thread ridge of the externally threaded member.

5. The scroll compressor of claim 2, wherein the externally threaded member is a set screw.

6. The scroll compressor of claim 1, wherein the insertion member is an externally threaded member.

7. The scroll compressor according to claim 1, further comprising a rotary shaft provided in the housing, and a backpressure chamber that is provided on an opposite side of the compression chamber with respect to the movable scroll, wherein an end of the rotary shaft is exposed to the backpressure chamber, and the backpressure chamber is configured to communicate with the compression chamber, and the compression pressure region includes the compression chamber and the backpressure chamber.

8. The scroll compressor according to claim 7, wherein the rotary shaft is rotated by a motor, and the suction pressure region includes a motor chamber which receives the motor.

9. The scroll compressor of claim 1, wherein the oil supply passage includes a first oil supply passage connected to the suction pressure region and a second oil supply passage connected to the compression pressure region.

10. A scroll compressor according to claim 9, further comprising a second flow restrictor for the oil supply passage.

11. A scroll compressor according to claim 1, wherein the oil separation chamber is connected to both the compression pressure region and the suction pressure region through the oil supply passage having the flow restrictor.

12. The scroll compressor of claim 1, wherein the scroll compressor is configured for a vehicle air conditioner.

13. The scroll compressor of claim 1, wherein an entire length of the outer peripheral surface of the insertion member contacts the inner peripheral surface of the oil supply hole.

14. The scroll compressor of claim 1, further comprising a filter disposed upstream of the oil supply hole and configured to collect foreign matter contained in the lubricating oil before entering the flow restrictor.

15. A scroll compressor, comprising:

a housing having therein a discharge pressure region, a compression pressure region and a suction pressure region;

a fixed scroll fixed in the housing to form a discharge chamber serving as the discharge pressure region;

a movable scroll cooperating with the fixed scroll to form therebetween a compression chamber serving as the compression pressure region with rotation of a rotary shaft;

a motor rotating the rotary shaft and received in a motor chamber serving as the suction pressure region;

a backpressure chamber provided on an opposite side of the compression chamber with respect to the movable scroll, wherein an end of the rotary shaft is exposed to the backpressure chamber, and the backpressure chamber is configured to communicate with the compression chamber, and the compression pressure region includes the compression chamber and the backpressure chamber;

wherein the discharge pressure region includes an oil separation chamber for separating lubricating oil from refrigerant gas discharged from the compression chamber, wherein the oil separation chamber is connected to a first oil supply passage and a second oil passage, wherein the first oil supply passage is connected to the motor chamber and the second oil supply passage is connected to the backpressure chamber;

an oil supply hole formed in the fixed scroll;

the lubricating oil flowing through the oil supply hole, thereby preventing the flow of refrigerant gas through the oil supply hole; and an insertion member made of resin inserted in the oil supply hole, wherein a gap is formed between the oil supply hole and the insertion member that is fixedly inserted in the oil supply hole, and the gap is in the form of a spiral groove provided in an inner peripheral surface of the oil supply hole or an outer peripheral surface of the insertion member or the inner peripheral surface of the oil supply hole and the outer peripheral surface of the insertion member, wherein an entire length of the spiral groove is disposed inside the oil supply hole of the oil supply passage.

16. The scroll compressor of claim 15, wherein an entire length of the outer peripheral surface of the insertion member contacts the inner peripheral surface of the oil supply hole.

17. The scroll compressor of claim 15, further comprising a filter disposed upstream of the oil supply hole and configured to collect foreign matter contained in the lubricating oil before entering the flow restrictor.

* * * * *